US008002685B2

(12) United States Patent
Ho et al.

(10) Patent No.: US 8,002,685 B2
(45) Date of Patent: Aug. 23, 2011

(54) TWISTING EXERCISER

(76) Inventors: Wei-Teh Ho, Taipei (TW); Wei-Yu Ho, Taipei (TW)

( * ) Notice: Subject to any disclaimer, the term of this patent is extended or adjusted under 35 U.S.C. 154(b) by 0 days.

(21) Appl. No.: 12/657,595

(22) Filed: Jan. 25, 2010

(65) Prior Publication Data

US 2011/0183828 A1 Jul. 28, 2011

(51) Int. Cl.
*A63B 21/00* (2006.01)

(52) U.S. Cl. ..... 482/146; 482/147

(58) Field of Classification Search ..... 482/96, 482/132, 146, 147
See application file for complete search history.

(56) References Cited

U.S. PATENT DOCUMENTS

| | | | | |
|---|---|---|---|---|
| 4,989,860 | A * | 2/1991 | Iams et al. | 482/132 |
| D622,334 | S * | 8/2010 | Splane | D21/689 |
| 2010/0062914 | A1 * | 3/2010 | Splane | 482/96 |

* cited by examiner

*Primary Examiner* — Jerome W Donnelly
(74) *Attorney, Agent, or Firm* — Jackson IPG PLLC; Demian K. Jackson

(57) ABSTRACT

A twisting exerciser includes a base having an arched track arranged along the periphery thereof, two swivel arms each having a front end pivotally connected to a pivot at the top center of the base and a rear end provided with a knee pad and slidably coupled to the arched track of the base, a handlebar detachably fastened to a stem at the front side of the base and having two grips at the distal end and a connection rod for selectively joining the two swivel arms for synchronous movement along the arched track of the base.

4 Claims, 2 Drawing Sheets

TWISTING EXERCISER

BACKGROUND OF THE INVENTION

1. Field of the Invention

The present invention relates to physical exercising apparatus and more particularly, to a twisting exerciser.

2. Description of the Related Art

An unbalanced diet has an adverse effect upon health. Nowadays, people do more care about their health. In consequence, many exercising apparatus are recreated to fit different exercising requirements. Few leg-twisting exercisers are commercially available. Commercial leg-twisting exercisers are commonly heavy and expensive, not suitable for home use. Further, because different users have different body sizes. A fixed size of physical exerciser cannot fit all users.

SUMMARY OF THE INVENTION

The present invention has been accomplished under the circumstances in view. It is one object of the present invention to provide a twisting exerciser, which is practical for a twisting exercise to train the muscles of the legs, waist, abdomen and arms. It is another object of the present invention to provide a twisting exerciser, which is collapsible to reduce space occupation when not in use.

To achieve these and other objects of the present invention, a twisting exerciser comprises a base, which has an arched track arranged along the periphery thereof, a stem extended from the front side thereof and a stop block protruded from the convex top wall thereof at each of the two distal ends of the arched track, a plurality of foot members detachably affixed to the front side of the base for supporting said base on a flat surface in a tilted position, a pivot located on the center of the convex top wall of the base, two swivel arms each having a front end pivotally connected to the pivot and a rear end provided a top knee pad and a bottom roller that is coupled to the arched track of the base, and a handlebar that has one end detachably fastened to the stem of the base and the other end provided with two grips.

Further, each swivel arm has an eye lug on the middle. Further, a connection rod is selectively used for joining the swivel arms for synchronous movement along the arched track of the base.

DETAILED DESCRIPTION OF THE PREFERRED EMBODIMENT

Figure 1:
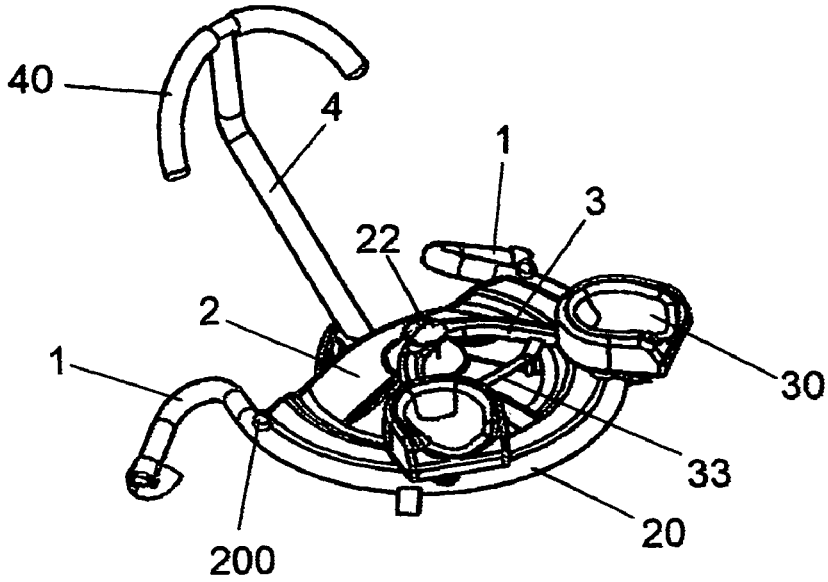
FIG. 1 is a perspective view of a twisting exerciser in accordance with the present invention.
Figure 2:
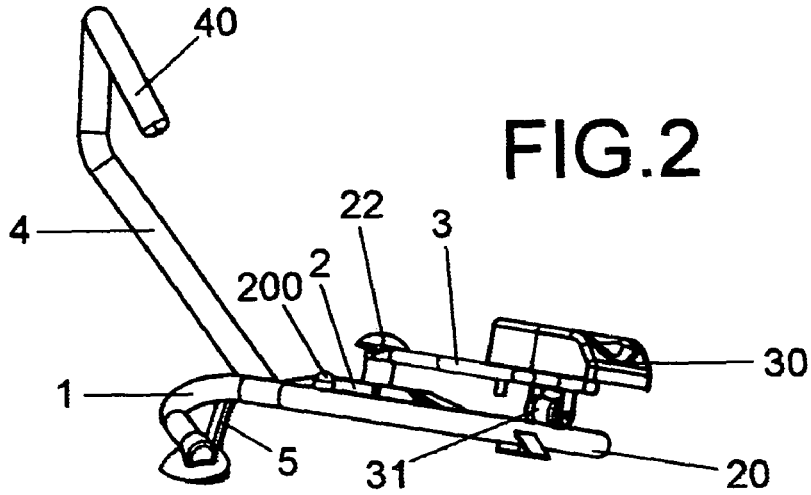
FIG. 2 is a side view of the twisting exerciser in accordance with the present invention.
Figure 3:
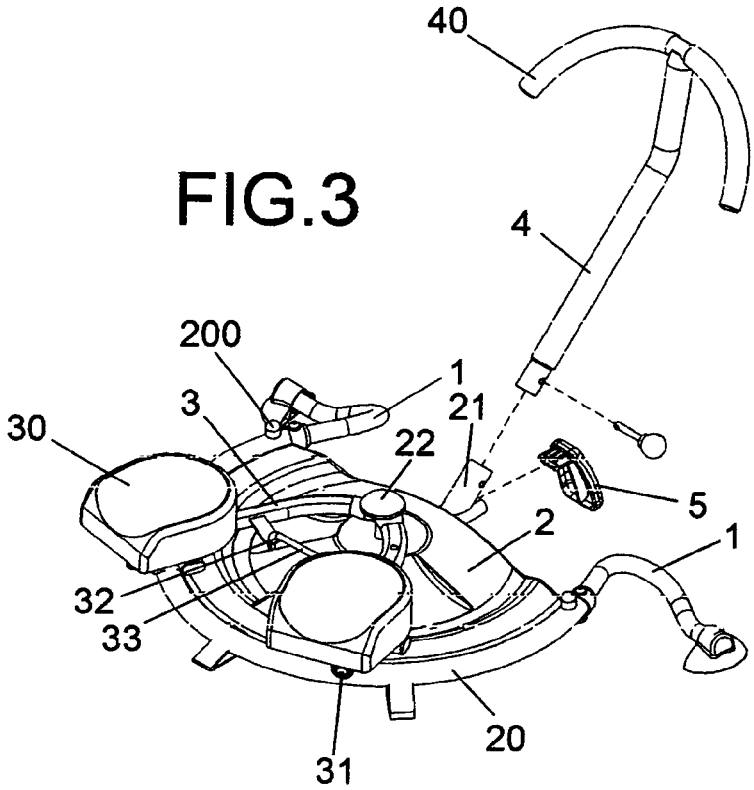
FIG. 3 is an exploded view of the twisting exerciser in accordance with the present invention.
Figure 4:
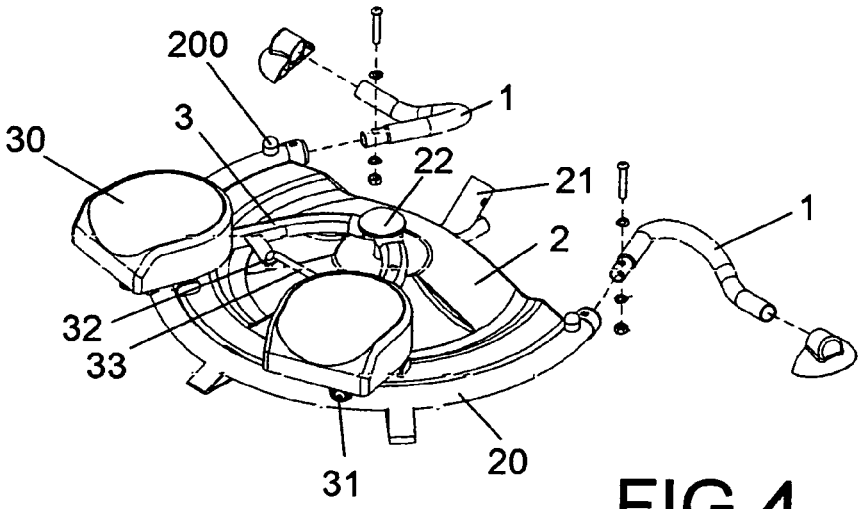
FIG. 4 is another exploded view of the twisting exerciser in accordance with the present invention (the handlebar excluded).

Referring to FIGS. 1~4, a twisting exerciser in accordance with the present invention is shown comprising foot members 1 and 5, a base 2, two swivel arms 3 and a handlebar 4.

The base 2 is shaped like a dome, having an arched track 20 arranged along the periphery thereof and a stop block 200 protruded from the convex top wall thereof at the front side of each of the two distal ends of the arched track 20. The foot members 1 and 5 are detachably affixed to the front side of the base 2 to support the base 2 on the floor in a tilted position. The swivel arms 3 are respectively pivotally connected to the center of the convex top wall of the base 2 with a pivot 22, each having a knee pad 30 located on the free end thereof and a roller 31 pivotally mounted on the bottom side of the free end beneath the knee pad 30 and coupled to the arched track 20 of the base 2. Further, a stem 21 extends from the front side of the base 2 for the mounting of the handlebar 4, which has two grips 40 at the front side thereof. The handle bar extends substantially vertically at an angle away from said exercise device. Further, each swivel arm 3 has an eye lug 32 on the middle. A connection rod 33 is detachably fastened to the eye lugs 32 of the swivel arms 3 to join the swivel arms 3 for synchronous movement along the arched track 20 of the base 2.

During operation, the foot members 1 and 5 are placed on the floor to support the base 2 in a tilted position, and then the handlebar 4 is attached to the stem 21. At this time, the user can rest the knees on the knee pads 30 and holds the grips 40 with the hands, and then twist the legs, the waist and the abdomen to turn the swivel arms 3 back and forth about the pivot 22 in reversed directions and along the arched track 20. Further, the stop blocks 200 limit the moving range of the swivel arms 3 on the arched track 20. Repeating this exercising manner, the muscles of the legs, waist, abdomen and arms are trained. Further, the user can fasten the connection rod 33 to the eye lugs 32 of the swivel arms 3 to join the swivel arms 3 for synchronous movement along the arched track 20 of the base 2.

When not in use, the foot members 1 and 5 and the handlebar 4 can be detached from the base 2 to reduce space occupation.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A twisting exerciser, comprising:

a base, said base having an arched track arranged along the periphery thereof, a stem extended from a front side thereof and a stop block protruded from a convex top wall thereof at each of two distal ends of said arched track;

a plurality of foot members detachably affixed to the front side of said base for supporting said base on a flat surface in a tilted position;

a pivot located on the center of the convex top wall of said base;

two swivel arms respectively pivotally connected to said pivot, each said swivel arm having a front end pivotally connected to said pivot, a rear end suspending above said base, a knee pad located on said rear end at a top side and a roller pivotally mounted on said rear end at a bottom side opposite to said knee pad and coupled to said arched track of said base through said roller being shaped to partially conforming to said arched track; and a handlebar detachably fastened to said stem of said base, said handlebar extends substantially vertically at an angle away from said exercise device.

2. The twisting exerciser as claimed in claim 1, further comprising a connection rod for joining said swivel arms, said connection rod having two distal ends detachably connectable to an eye lug at each of said swivel arms.

3. The twisting exerciser as claimed in claim 1, wherein said handlebar is a single handlebar having a single elongated body with two grips at an end opposite said stem.

4. The twisting exerciser as claimed in claim 1, wherein said plurality of foot members are three foot members.

* * * * *